US007025930B2

(12) United States Patent
Okumura et al.

(10) Patent No.: US 7,025,930 B2
(45) Date of Patent: Apr. 11, 2006

(54) PROCESS FOR HANDLING POWDER GREEN COMPACTS, AND RARE EARTH METAL-BASED MAGNET

(75) Inventors: Shuhei Okumura, Osaka (JP); Hiroshi Hashikawa, Osaka (JP)

(73) Assignee: Neomax Co. Ltd., Osaka (JP)

( * ) Notice: Subject to any disclaimer, the term of this patent is extended or adjusted under 35 U.S.C. 154(b) by 548 days.

(21) Appl. No.: 10/357,355

(22) Filed: Feb. 4, 2003

(65) Prior Publication Data

US 2003/0143100 A1 Jul. 31, 2003

Related U.S. Application Data

(62) Division of application No. 09/440,100, filed on Nov. 15, 1999, now Pat. No. 6,537,488.

(30) Foreign Application Priority Data

Nov. 17, 1998 (JP) ..... 10-343552

(51) Int. Cl.
*B22F 3/12* (2006.01)

(52) U.S. Cl. ..... 419/38; 419/44; 419/66

(58) Field of Classification Search ..... 419/38, 419/44, 66; 269/20, 57
See application file for complete search history.

(56) References Cited

U.S. PATENT DOCUMENTS 4,075,042 A * 2/1978 Das ..... 148/103
5,383,978 A * 1/1995 Yamamoto et al. ..... 148/101
5,737,683 A * 4/1998 Sterzel ..... 419/36
6,352,598 B1 * 3/2002 Hisamura et al. ..... 148/108
6,432,158 B1 * 8/2002 Harada et al. ..... 75/245

FOREIGN PATENT DOCUMENTS

| | | |
|---|---|---|
| EP | 0 556 751 A1 | 8/1993 |
| JP | 60-141103 | 9/1985 |
| JP | 01-299123 | 12/1989 |
| JP | 08-316074 | 11/1996 |

OTHER PUBLICATIONS

Japanese Office Action with English Translation dated Sep. 12, 2003.
Patent Abstracts of Japan; Publication No. 61125114; Publication Date, Dec. 6, 1986.
Powder Metallurgy; 1999; vol. 42; No. 1; pp. 41-44.

* cited by examiner

*Primary Examiner*—Daniel Jenkins
(74) *Attorney, Agent, or Firm*—Armstrong, Kratz, Quintos, Hanson & Brooks, LLP

(57) ABSTRACT

In a process for handling green compacts made from a rare earth metal-based magnetic alloy powder by a press machine to slide, on a sintering support plate, the green compacts, the support plate used has a surface roughness degree Ra in a range of 0.6 to 47 μm. At a first step, the green compacts are disposed in a first position near a final transport position, and at a second step, the said green compacts disposed in the first position are slid on the sintering support plate and disposed in the final transport position. Thus, by using the support plate having a surface roughness degree in a particular range, the green compacts made from the rare earth metal-based magnetic alloy powder can be sintered without occurrence of the deposition of the green compacts to the support plate, the chipping of the green compacts and the like. In addition, the efficiency of operation of the press machine can be increased.

1 Claim, 7 Drawing Sheets

PROCESS FOR HANDLING POWDER GREEN COMPACTS, AND RARE EARTH METAL-BASED MAGNET

This application is a DIV of Ser. No. 09/440,100 filed Nov. 15, 1999 now U.S. Pat. No. 6,537,488.

BACKGROUND OF THE INVENTION

1. Field of the Invention

The present invention relates to a process for handling a green compact made by a press machine from a rare earth metal-based magnetic alloy powder such as an Fe—B—R based magnetic alloy powder, wherein R comprises at least one rare earth element. The present invention also relates to a rare earth metal-based magnet produced through such handling process.

2. Description of the Related Art

It is a conventional practice for producing a rare earth metal-based magnet to press a rare earth metal-based magnetic alloy powder into a predetermined shape in a magnetic field by a press machine, and to arrange green compacts produced in the above manner on a sintering support plate to transport them into a sintering furnace, where they are sintered.

In this case, a press machine 10 and a sintering support plate 15 shown in FIG. 12 are used for the handling of the green compacts made from the rare earth metal-based magnetic alloy powder by the press machine to transport the green compacts to the sintering support plate. The green compacts 1 formed into a predetermined shape from the rare earth metal-based magnetic alloy powder by the press machine are pushed out onto a stage 12 by a push-out means 11 such as pusher and subjected to a powder removing treatment in which a surplus magnetic powder around the green compacts 1 is blown away by a nitrogen gas or the like blown out of a powder removing device 13. Then, the green compacts are pushed out onto a transporting belt 14 by the push-out means 11. The green compacts are transported to near the sintering support plate 15 by the transporting belt 14 and then pushed out onto the sintering support plate 15 from the transporting belt 14 by a push-out means 16 such as a pusher. Thus, a large number of the green compacts can be arranged efficiently on the narrow sintering support plate of a simple construction and hence, the above-described steps are repeated, thereby allowing the succeeding green compacts 1 to sequentially push the already transported preceding green compacts to slide them on the sintering support plate 15, as shown in FIGS. 13 and 14. In this manner, all the green compacts 1 are arranged in a final transport position on the sintering support plate 15. In FIG. 12, reference character 10*a* designates an upper punch of the press machine 10; reference character 10*b* designates a die of the press machine 10; reference character 10*c* designates a box (feeder) for supplying the magnetic alloy powder to the press machine 10; and reference character 10*d* designates a magnetic field generating coil.

However, the rare earth metal-based alloy powder such as the Fe—B—R (R comprising at least one rare earth element) based magnetic alloy powder has a large hardness as compared with ferrite. For this reason, if such powder is pressed too strongly, the die is worn. If the powder is pressed at a high pressure, the orientation tends to be disordered, resulting in a degraded magnetic characteristic. Therefore, in order to provide a higher magnetic characteristic pressing force, the pressing pressure can be less risen and hence, the green compacts are liable to brittle and destroyed, as compared with ferrite. Particularly, a rare earth metal-based magnetic alloy powder made by the strip casting process and having an excellent magnetic characteristic has a small average particle size and moreover, has a narrow and sharp particle size distribution. Therefore, green compacts produced from such rare earth metal-based magnetic alloy powder are soft, a poor shaping property, and difficult to handle, as compared with a powder which is made by a mold-casting process and whose particle size distribution varied widely. A green compact made by pressing from a powder containing a lubricant such as an ester of an aliphatic acid added thereto is further brittle.

Because the green compacts are brittle as described above, it is necessary to handle the green compacts carefully by a transporting means such as a transporting belt, a pusher, a robot and the like. Especially, there is a problem that the powder removing treatment is time-consuming, and unless the powder removing treatment for the green compacts made in advance by pressing is finished, the pressing of the subsequent powder cannot be started, resulting in a significantly degraded efficiency of operation of the press machine.

To exhibit the magnetic characteristic sufficiently, it is necessary to conduct the pressing in a high magnetic field of 0.9 to 1.5 T and for this reason, it is necessary to demagnetize the green compacts by a counter magnetic field after the pressing. However, the perfect demagnetization cannot be achieved and for this reason, the powder scattered around the green compact is adsorbed. It is impossible to advance the process without carrying-out of this powder removing treatment and hence, an increase in efficiency of the powder removing treatment is a large subject.

The use of the sintering support plate having a high friction coefficient is preferred in order to ensure that the green compacts are prevented from slipping on the sintering support plate to come into close contact with another green compact, or to become fallen, during transportation of the sintering support plate to the sintering furnace. Particularly, the R—Fe—B based magnet is produced in a liquid-phase sintering manner. For this reason, if a very smooth support plate is used, neodymium (Nd) eluted during the sintering is deposited onto the support plate and hence, it is necessary to use a support plate having a high friction coefficient. For this reason, there is arisen a problem that the green compacts which are slid through a longer distance, i.e., arranged earlier, are cracked at their bottoms, and in a severe case, the green compacts are destroyed before the sintering. To push out the green compacts in a first row, the green compacts, if being pushed by a friction force corresponding to one green compact, can be slid on the support plate. However, it is necessary to push the green compacts in an n-th row by a friction force corresponding to an n-number of green compacts, and such friction force is applied locally to the green compacts in the n-th row. If such friction force is larger than the strength of the green compacts, the green compacts are crushed and destroyed. In addition, the green compacts in the first row are slid through a distance corresponding to the n-rows and for this reason, are chipped at their bottoms

SUMMARY OF THE INVENTION

Accordingly, it is an object of the present invention to provide a process for handling green compacts made from a rare earth metal-based magnetic alloy powder, wherein the problems associated with the prior art can be eliminated; the deposition of the green compacts to the support plate does not occur, the efficiency of operation of the press machine can be increased, and the cracking and chipping of the green compacts do not occur during movement of the green compacts on the sintering support plate. It is another object of the present invention to provide a rare earth metal-based magnet which is produced through the above handling process.

To achieve the above object, according to a first aspect and feature of the present invention, there is provided a process for handling green compacts made from a rare earth metal-based magnetic alloy powder, comprising the step of sliding, on a sintering support plate, green compacts made from a rare earth metal-based magnetic alloy powder by a press machine, wherein the support plate used has a surface roughness degree Ra in a range of 0.6 to 47 μm.

According to a second aspect and feature of the present invention, in addition to the first feature, the rare earth metal-based magnetic alloy powder for forming the green compacts contains a lubricant added thereto.

According to a third aspect and feature of the present invention, in addition to the first feature, the rare earth metal-based magnetic alloy powder for forming the green compacts is produced by a strip casting process.

According to a fourth aspect and feature of the present invention, in addition to the second feature, the rare earth metal-based magnetic alloy powder for forming the green compacts is produced by a strip casting process.

According to a fifth aspect and feature of the present invention, there is provided a process for handling green compacts made from a rare earth metal-based magnetic alloy powder by a press machine, comprising the step of transporting the green compacts made from the rare earth metal-based magnetic alloy powder by a press machine once onto a turn table, subjecting the green compacts to a powder removing treatment on the turn table, and transporting the green compacts to a sintering support plate.

With the above features, by using the support plate having a surface roughness degree in a particular range, the green compacts made from the rare earth metal-based magnetic alloy powder can be sintered without occurrence of the deposition of the green compacts to the support plate, and handled without occurrence of the chipping of the green compacts and the like. In addition, the efficiency of operation of the press machine can be increased.

According to a sixth aspect and feature of the present invention, there is provided a process for handling green compacts made from a rare earth metal-based magnetic alloy powder by a press machine to slide, on a sintering support plate, the green compacts made from the rare earth metal-based magnetic alloy powder by the press machine, comprising a first step of disposing the green compacts in a first position near a final transport position, and a second step of sliding the green compacts disposed in the first position on the sintering support plate and disposing the green compacts in the final transport position.

With the above feature, the distance of sliding movement can be shortened and hence, the cracking and chipping of the green compacts are difficult to occur.

According to a seventh aspect and feature of the present invention, in addition to the sixth feature, the support plate used has a surface roughness degree Ra in a range of 0.6 to 47 μμm.

According to an eighth aspect and feature of the present invention, in addition to the seventh feature, the rare earth metal-based magnetic alloy powder for forming the green compacts contains a lubricant added thereto.

According to a ninth aspect and feature of the present invention, in addition to the eighth feature, the rare earth metal-based magnetic alloy powder for forming the green compacts is produced by a strip casting process.

With the above features, by using the support plate having a surface roughness degree in a particular range, the green compacts made from the rare earth metal-based magnetic alloy powder can be sintered without generation of the deposition of the green compacts to the support plate, and handled without generation of the chipping of the green compacts and the like. In addition, the efficiency of operation of the press machine can be increased.

According to a tenth aspect and feature of the present invention, in addition to the sixth feature, the first position at the first step is established on the sintering support plate.

With the above feature, even the green compacts liable to be fallen can be moved reliably to the final transport position without occurrence of the cracking and chipping of the green compacts due to the sliding movement.

According to an eleventh aspect and feature of the present invention, the green compacts slide at the second step do not push the green compacts already disposed to slide them.

With the above feature, the green compacts cannot be depressed.

According to a twelfth aspect and feature of the present invention, in addition to the sixth feature, the first position at the first step is established on a thin member mounted on the sintering support plate.

According to a thirteenth aspect and feature of the present invention, in addition to the twelfth feature, the green compacts slid at the second step do not push the green compacts already disposed to slide them.

With the above feature, the green compacts cannot be depressed.

According to a fourteenth aspect and feature of the present invention, there is provided a rare earth metal-based magnet which is produced through a handling process according to the first aspect and feature.

According to a fifteenth aspect and feature of the present invention, there is provided a rare earth metal-based magnet which is produced through a handling process according to the sixth aspect and feature.

According to a sixteenth aspect and feature of the present invention, there is provided a rare earth metal-based magnet which is produced through a handling process according to the tenth aspect and feature.

According to a seventeenth aspect and feature of the present invention, there is provided a rare earth metal-based magnet which is produced through a handling process according to the twelfth aspect and feature.

With the above features, it is possible to produce a rare earth metal-based magnet at an excellent yield, because of no occurrence of the cracking and chipping of the green compacts.

The above and other objects, features and advantages of the invention will become apparent from the following description of the preferred embodiment taken in conjunction with the accompanying drawings.

DESCRIPTION OF THE PREFERRED EMBODIMENT

Figure 1:
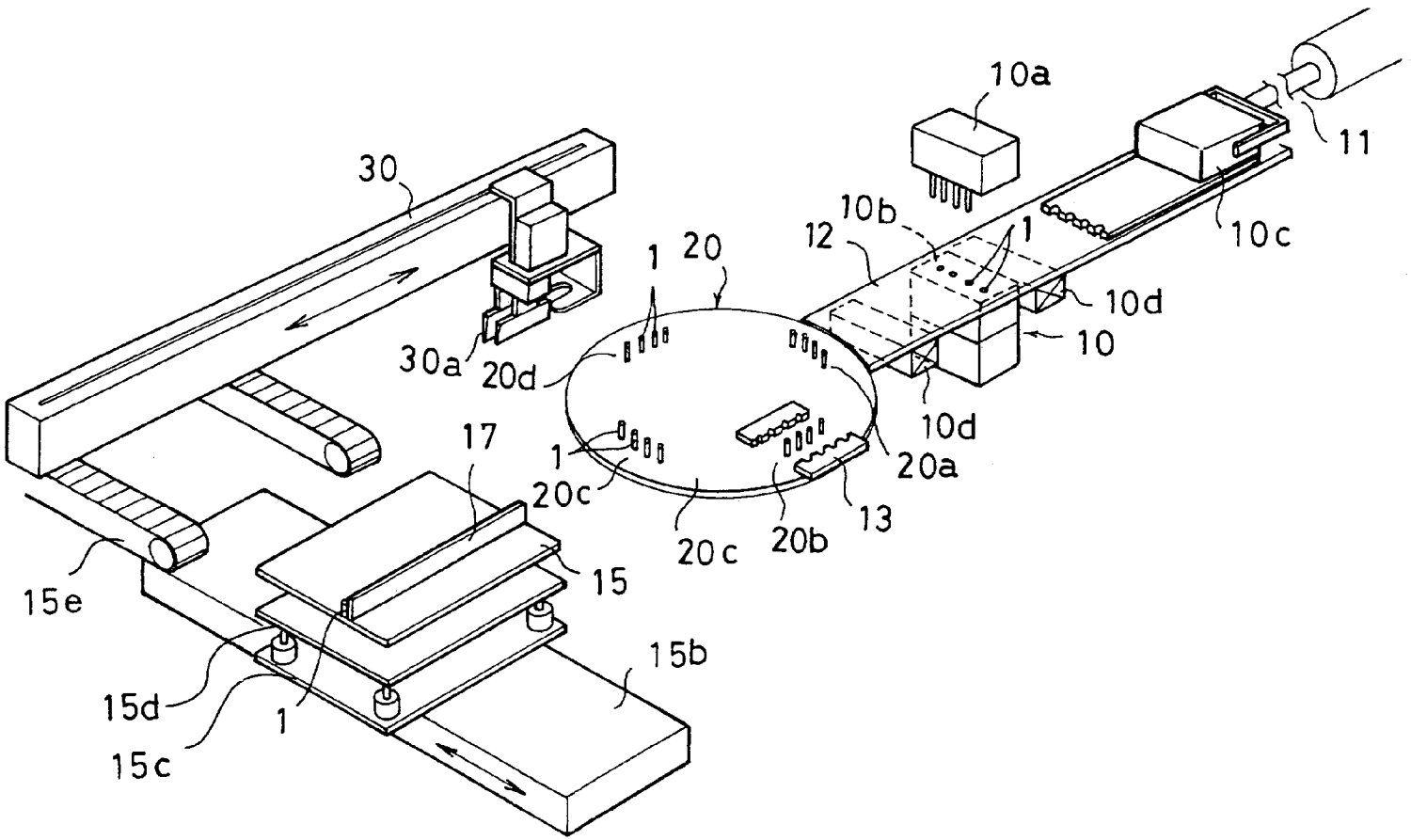
FIG. 1 is a perspective view of the arrangement of a transporting system for carrying out a process for handling green compacts made from a rare earth metal-based magnetic alloy powder by a press machine according to the present invention.

A process for handling green compacts made of a rare earth metal-based magnetic alloy power according to the present invention will now be described by way of a particular embodiment.

A rare earth metal-based magnetic alloy power used in this example was prepared in the following manner:

First, a thin ingot was produced using a strip casting process as shown in U.S. Pat. No. 5,383,978.

More specifically, an alloy produced in the known process and having a composition comprising 30% by weight of Nd, 1.0% by weight of B, 1.2% by weight of Dy, 0.2% by weight of Al, 0.9% by weight of Co, the balance of Fe and inevitable impurities was subjected to a high-frequency melting to provide a molten metal. This molten metal was maintained at 1,350° and then, quenched on a single roll under conditions of a roll peripheral speed of about 1 mm/sec, a cooling rate of 500°/sec and a super-cooling degree of 200°, thereby providing a flake-shaped alloy ingot.

Then, the alloy ingot was coarsely pulverized in a hydrogen-inclusion manner and then finely pulverized in an atmosphere of nitrogen gas using a jet mill, thereby producing an alloy powder having an average particle size of 3.5 μm.

Subsequently, a solution made by diluting an ester of an aliphatic acid used as a lubricant by a solvent such as a petroleum solvent was added in an amount of 0.3% by weight based on the lubricant to the produced alloy powder and mixed with the latter in a rocking mixer, whereby the lubricant was coated onto a surface of the alloy powder. In this case, methyl caproate was used as the ester of the aliphatic acid, and iso-paraffin was used as the petroleum solvent. Further, the weight ratio of methyl caproate to iso-paraffin was set at 1:9.

The composition of the rare earth metal-based alloy described in U.S. Pat. No. 4,770,423 can be employed beside the above-described composition.

Then, a cylindrical rare earth metal-based magnetic alloy powder green compact having an inside diameter of 2 mm, an outside diameter of 4 mm and a height of 6 mm was produced using the produced rare earth metal-based magnetic alloy powder. The pressing conditions are a magnetic field of 1.0 T and a compact density of 4.4 g/cm$^3$.

The type of the lubricant is particularly not limited, and for example, a lubricant made by diluting an ester of an aliphatic acid with a solvent can be used. Examples of the esters of the aliphatic acids are methyl caproate, methyl caprylate, methyl laurate, methyl laurylate and the like. Examples of the solvents which may be used are petroleum solvents such as iso-paraffin and naphthenic solvent. A blend of an ester of an aliphatic acid and a solvent mixed together at a weight ratio of 1:20 to 1:1 may be used. Arachidic acid may be contained in an amount of 1.0% by weight in the aliphatic acid. A solid lubricant such as zinc stearate may also be used in place of, or along with the liquid lubricant.

Support plates made of molybdenum having the following surface roughness degrees, a size of 30 cm×30 cm and a thickness of 1 mm, was prepared as samples (1) to (8).

Figure 12:
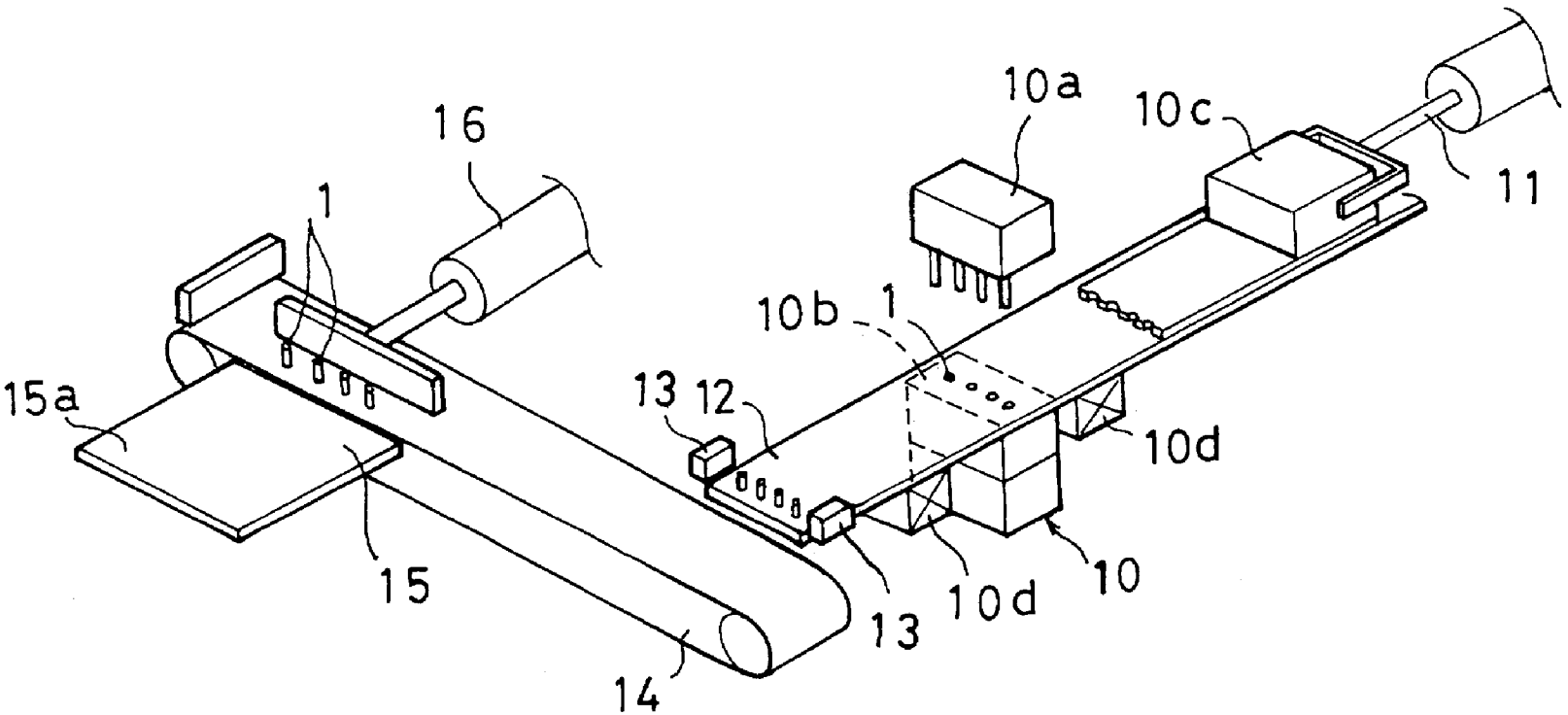
FIG. 12 is a perspective view of the arrangement of a transporting system for carrying out a conventional process for handling green compacts made from a rare earth metal-based magnetic alloy powder by a press machine.
Figure 13:
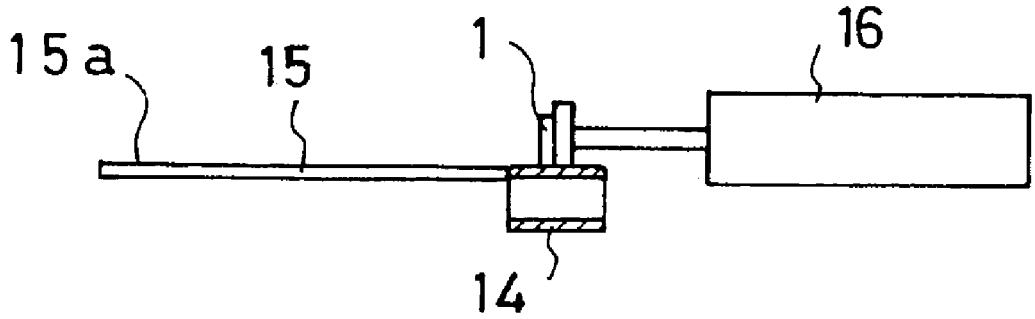
FIG. 13 is a diagram for explaining one step of the handling process.
Figure 14:
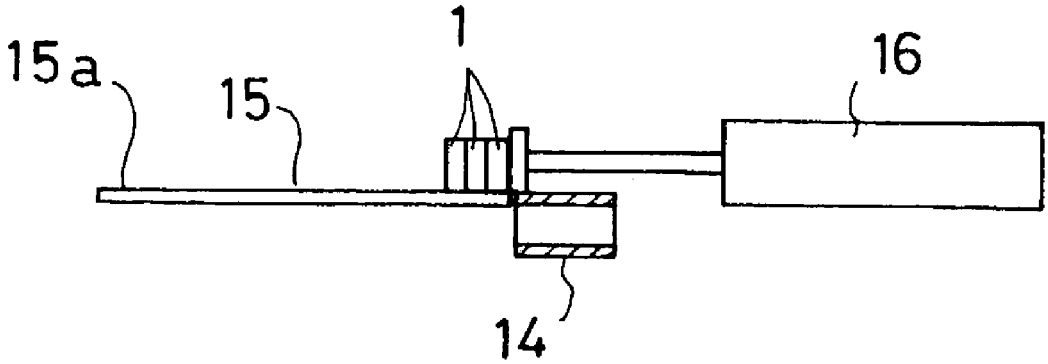
FIG. 14 is a diagram for explaining one step of the handling process.

Then, the cylindrical green compacts were arranged five at one time in a row on each of the support plates as the samples (1) to (8) and pushed out sequentially in the order of from the rearmost to the foremost using an apparatus shown in FIGS. 12 to 14, whereby the 30 green compacts in total were arranged in rows on each of the support plates. This support plate was placed into a sintering furnace, where it was subjected to a sintering treatment for 2 hours at 1,100° C. in an atmosphere of argon.

The samples (1) to (8) used are those described below.

(1) A support plate comprising a plate of molybdenum subjected to no treatment.

(2) A support plate made by subjecting a plate of molybdenum to a shot blasting with #180 abrasive grains.

(3) A support plate made by subjecting a plate of molybdenum to a shot blasting with #60 abrasive grains.

(4) A support plate made by flame spray coating of Yttria on a plate of molybdenum.

(5) A support plate made by flame spray coating of Yttria on a plate of molybdenum.

(6) A support plate made by flame spray coating of Yttria on a plate of molybdenum.

(7) A support plate made by subjecting a plate of molybdenum to a milling treatment to roughen the surface of the sintering plate.

(8) A support plate made by subjecting a sintering plate of molybdenum to a milling treatment to roughen the surface of the sintering plate.

In the examples (4) to (6), the surface roughness degree was adjusted by controlling the particle size of particles to be flame-sprayed.

The surface roughness degrees of the above samples was measured, thereby providing the following values:

| | Surface roughness degree (Ra) (μm) | Surface roughness degree (Rmax) (μm) |
|---|---|---|
| (1) | 0.04 | 1.4 |
| (2) | 0.6 | 8.9 |
| (3) | 2.3 | 22.9 |
| (4) | 5.2 | 43.7 |

-continued

| | Surface roughness degree (Ra) (μm) | Surface roughness degree (Rmax) (μm) |
|---|---|---|
| (5) | 10.8 | 56.0 |
| (6) | 13.4 | 66.0 |
| (7) | 47.0 | 210.0 |
| (8) | 61.0 | 265.0 |

In the case of the sample (1), it was found that when the sintered products were intended to be removed from the sintering plate after the sintering treatment, most of them were deposited on the sintering support plate. A portion of a deposited area of the sintered product included a granular portion and was deposited strongly. Some of the sintered products could not be peeled off, unless they were broken or destroyed.

In the case of the sample (2), a granular portion could not be found, but eluted neodymium was deposited thinly on the support plate, and about one third of the total number of the sintered products were deposited lightly on the support plate. However, the sintered products were liable to be peeled off, and no chipping was produced.

In the case of the sample (3), a granular portion could not be found, but eluted neodymium was deposited slightly on the support plate, and a few sintered products were deposited on the support plate to such an extent that they were peeled off extremely easily. No chipping of the sintered product was produced.

In the case of the sample (4), the deposition and elusion were not observed. In addition, no chipping of the sintered product was produced.

In the case of the sample (5), the deposition and elusion were not observed. In addition, no chipping of the sintered product was produced.

In the case of the sample (6), no deposition and elusion were observed. In addition, no chipping of the sintered product was produced.

In the case of the sample (7), a very small chipping was produced in a few sintered products. This chipping was believed to be produced during movement of the sintered products on the support plate. No deposition was produced.

In the case of the sample (8), a very small chipping was produced in each of about ten sintered products. This chipping was believed to be produced during movement of the sintered products on the support plate. No deposition was produced.

In this way, it was confirmed that the rare earth metal-based magnetic alloy powder green compacts could be handled and sintered without depositing and chipping by using the support plate having a surface roughness degree Ra in a range of 0.6 to 47 μm. In this case, it is preferable that the support plate has a surface roughness degree Rmax in a range of 8.9 to 210.

In particular, it was confirmed that the rare earth metal-based magnetic alloy powder green compacts could be reliably handled without occurrence of chipping and sintered without being deposited and with no elution, by using the support plate having a surface roughness degree Ra in a range of 2.3 to 13.4 μm and a surface roughness degree Rmax in a range of 23 to 66.

Another embodiment of a process for handling a rare earth metal-based magnetic alloy powder green compact will now be described with reference to the accompanying drawings.

In this embodiment, the structure around a press machine 10 is particularly not different from that in the prior art. Therefore, members or components corresponding to those in the prior art are designated by like reference characters, and the description of them is omitted.

In this embodiment, as shown in FIG. 1, the green compacts are transferred from the press machine 10 onto the sintering support plate 15 through a turn table 20 which is disposed between the press machine 15 and the sintering support plate 15 and rotated through 90 degrees at one time. In this apparatus, the green compacts are subjected a powder removing treatment carried out by a powder removing device 13 comprising an air jet in a powder removing position 20*b* on the turn table 20 which has been rotated through 90 degrees from a receiving position 20*a* from the press machine 10. Reference character 20*c* in FIG. 1 indicates a stand-by position provided between the powder removing position 20*b* and a transport position 20*d*.

In the transport position 20*d* angularly displaced through 180 degrees from the powder removing position 20*b* on the turn table 20 rotated sequentially through every 90 degrees, as described above, the green compacts 1 are grasped by an air chuck 30*a* of a transporting robot 30 and transported onto the sintering support plate 15.

As described above, the green compacts 1 required to be handled carefully is subjected to the powder removing treatment by the powder removing device 13 after being once transported sequentially onto the turn table 20 from the press machine 10. Therefore, it is possible to advance to a next pressing operation without waiting for the completion of the powder removing treatment which is now being conducted, and hence, the pressing operation can be carried out continuously and smoothly by the press machine 10. In addition, the period of time taken for one run of the pressing operation can be shortened by 25% as compared with the prior art, leading to an enhanced productivity.

In this embodiment of the process for handling the green compacts made by the press machine from the rare earth metal-based magnetic alloy powder, the green compacts are disposed in a first position near a final transport position. At a second step, the green compacts disposed in the first position are slid on the sintering support plate and disposed in the final transport position. The first position at the first step is established on the sintering support plate.

Figure 2:
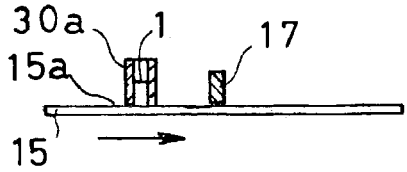
FIG. 2 is a diagram for explaining one step of the handling process.
Figure 3:
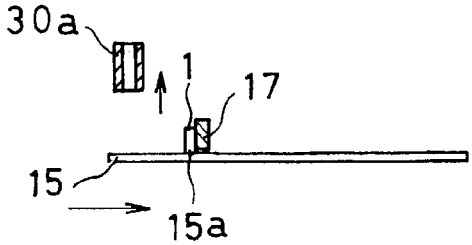
FIG. 3 is a diagram for explaining one step of the handling process.
Figure 4:
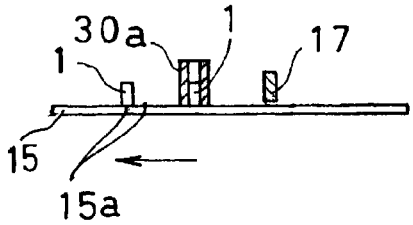
FIG. 4 is a diagram for explaining one step of the handling process.
Figure 5:
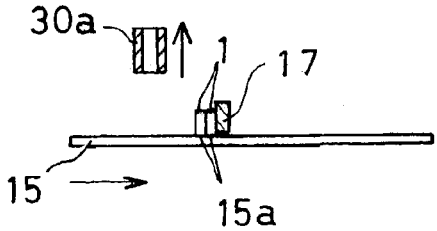
FIG. 5 is a diagram for explaining one step of the handling process.

More specifically, when the green compacts 1 are to be transported from the transport position on the turn table 20 onto the sintering support plate 15 by the transporting robot 30, the green compacts 1 in one row are once transported sequentially to as near as possible to the final transporting portion 15*a* on the sintering support plate 15 as shown in FIG. 2 with a range of movement of the robot taken into consideration. In this case, the distance between the green compacts 1 and the final transport position is 2 cm. Then, as shown in FIG. 3, the sintering support plate 15 is moved toward a stationary member 17, whereby the green compacts 1 in one row are put into abutment against the stationary member 17 and located in the final transport position 15*a* on the sintering support plate 15. Further, as shown in FIG. 4, the green compacts 1 in one row are transported sequentially in the same manner to near the final transport position 15*a* on the sintering support plate 15. Thereafter, as shown in FIG. 5, the green compacts 1 in the second row are brought into abutment against the stationary member 17 by moving the sintering support plate 15 toward the stationary member 17, and then slid on the sintering support plate 15 to the final transport position 15*a*, whereby they are put into abutment slightly against the green compacts which have been transported in advance. At this moment, the green compacts in the second row do not push and slide the compacts already transported. Accordingly, the compacts cannot be pushed to be cruched due to the friction force. Such transporting operation is repeated to transport all of the green compacts 1 to the final transport position 15*a* on the sintering support plate 15.

In the prior art, the compacts in the first row moved through the maximum distance are slid through about 20 cm, but in this embodiment, the distance of sliding movement of the green compacts 1 in each row is 2 cm. Thus, the distance of movement of the green compacts 1 on the sintering support plate 15 can be shortened extremely. In addition, the green compacts arranged in more rear row cannot be depressed. As a result, the yield can be increased by 40%, as compared with the prior art. In this embodiment, there is the slight sliding distance as compared with an embodiment which will be described hereinafter, but there is no difference in level and hence, this embodiment is suitable for arranging fine compacts formed cylindrical shape or the like and liable to be fallen. The support plate 15 with compacts 1 in all-rows arranged thereon is transported along with a base plate 15*c* and an adsorbing device 15*d* by a transporting device 15*b* and then transported by a support plate transporting belt 15*e* after releasing of the adsorption of the support plate.

Figure 6:
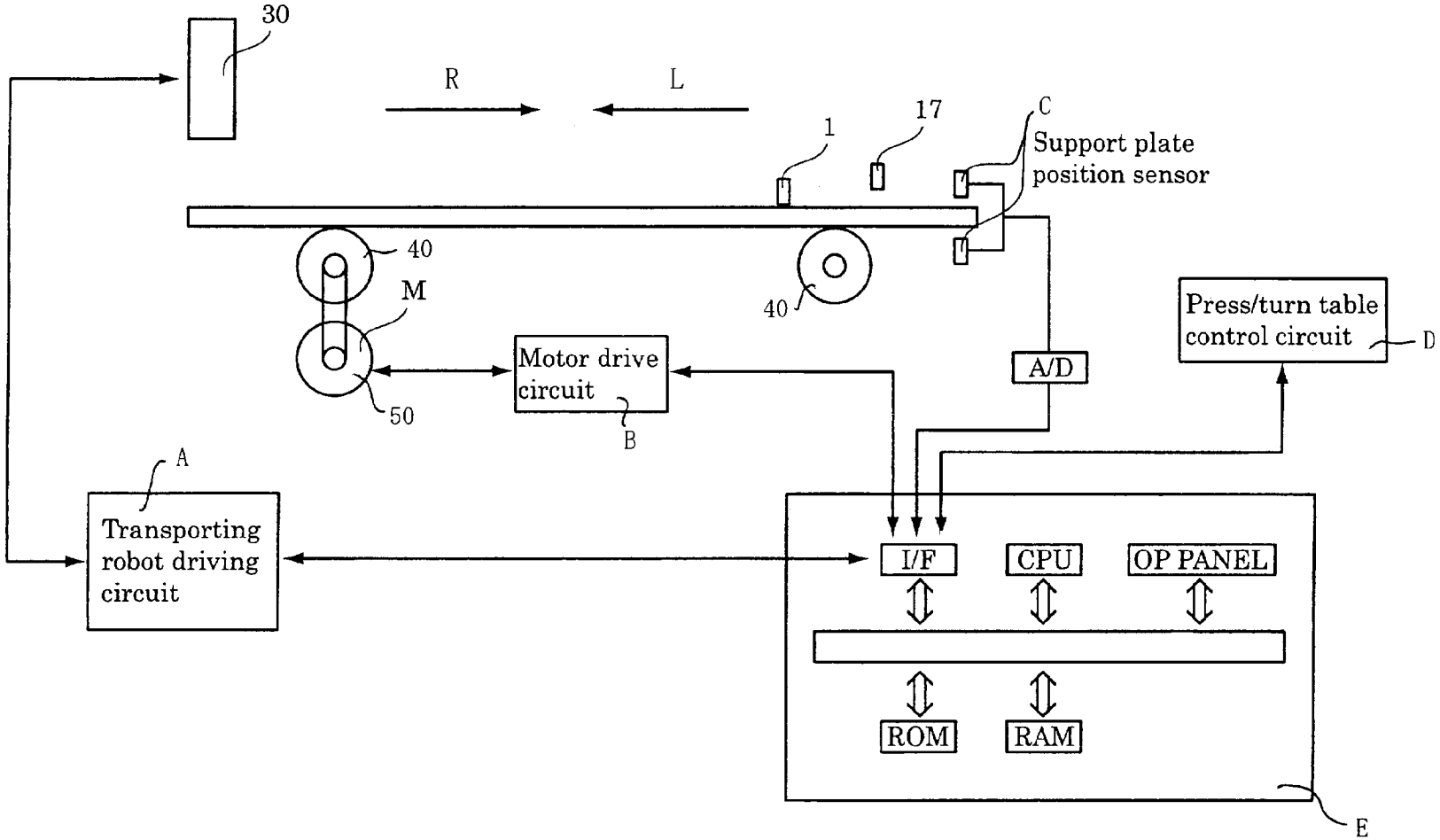
FIG. 6 is a diagram illustrating a control system for the above described transporting system.

As shown in FIG. 6, a control system is comprised of a transporting-robot driving circuit A, a motor driving circuit B, a support plate position sensor C, a press/turn table control circuit D and a general control circuit E.

The transporting-robot driving circuit A controls the grasping of the green compacts 1 in the air chuck 30*a* of the transporting robot 30 and the position of the air chuck 30*a*. The motor driving circuit B, which comprises a pulse generating circuit, controls the driving of a stepping motor 50 for moving a roller 40 adapted to support the sintering support plate 15 for transportation. For convenience of the description, the roller 40 is described in FIG. 6 as being driven in abutment against sintering plate 15 unlike FIG. 1. The support plate position sensor C comprises a photo-interrupter and delivers an output which is supplied to an hF section in an A/D converted form. The press/turn table control circuit D controls the operations of the press machine including an upper punch 10*a*, a die 10*b*, a supply box 10*c* and a magnetic field generating coil 10*d* and of the turn table 20. The general control circuit E comprises an ROM having a controlling program accommodated therein, a CPU adapted to conduct the calculation based on the program accommodated in the ROM, a RAM which serves as a work area and has control data accommodated therein, an operation panel for selecting the control program according to the compact to be pressed by an operator, an I/F section adapted to provide an interface with another hardware, and a bus for connecting these components.

The particular control conducted by the control system will be described below.

The support plate 15 is disposed on the roller 40, and a manufacture program is selected by the operator. When a start button is pushed down, an initializing operation is started in the entire apparatus.

At that time, the support plate 15 is moved by the motor control circuit B controlled by the general control circuit F, and is then set at a predetermined location. At that time, the CPU indicates it to the motor drive circuit B through the I/F section that the support plate 15 is driven in a direction indicated by R after detection of the face that the support plate 15 is not in a position to block the interrupter. At the same time, the CPU periodically checks by the support plate position sensor C that the support plate 15 has reached to the position to block the interrupter. At a time point when an end of the support plate 15 has been detected, the support plate 15 is returned in a direction indicated by L through a predetermined distance and set in a position in which the first green compacts 1 are placed on the support plate 15.

Even in the transporting robot driving circuit A, an initializing operation such as the detection of the position of the air chuck 30*a* is carried out. Further, a similar initializing operation is also carried out in the press/turn table control circuit D. When all the initializing operations have been completed and READY signals have been transmitted from all the control circuits to the I/F section, the CPU indicates the starting of the pressing to the press/turn table control circuit D. In the press/turn table control circuit D, when it is detected that the green compacts 1 are in transport position 20*d*, a transporting command signal is transmitted to the I/F section. When the CPU has detected this signal, it indicates the transportation of the green compacts 1 to the transporting robot drive circuit A, whereby the green compacts 1 are transported onto the support plate 15. The CPU stores the number of transportation runs of the green compacts 1 on the RAM and indicates a transported position at every time based on the number of transportation runs.

The CPU detects that the number of transportation runs does not still reach a predetermined value. When it is detected by the CPU that the number of transportation runs has reached the predetermined value by repeating the above-described operation, i.e., that the green compacts in one row have been arranged, the support plate 15 is moved by the motor drive circuit B, as shown in FIGS. 2 to 5, and the green compacts 1 are disposed on the support plate 15. The CPU stores the number of disposing runs, i.e., the number of rows of the green compacts 1. When the CPU detects that the green compacts have been disposed, i.e., that a number of the green compacts corresponding to one support plate have been arranged, the CPU indicates that the support plate is transported by the support plate transporting belt.

Another embodiment of a process for handling green compacts made by a press machine from a rare earth metal-based magnetic alloy powder will now be described with reference to FIG. 7. In this embodiment, at a first step, the green compacts are disposed at a first position near a final transport position. At a second step, the green compacts disposed in the first position are slid on the sintering support plate and disposed in the final transport position. The first position at the first step is established on a thin member mounted on the sintering support plate.

Figure 7:
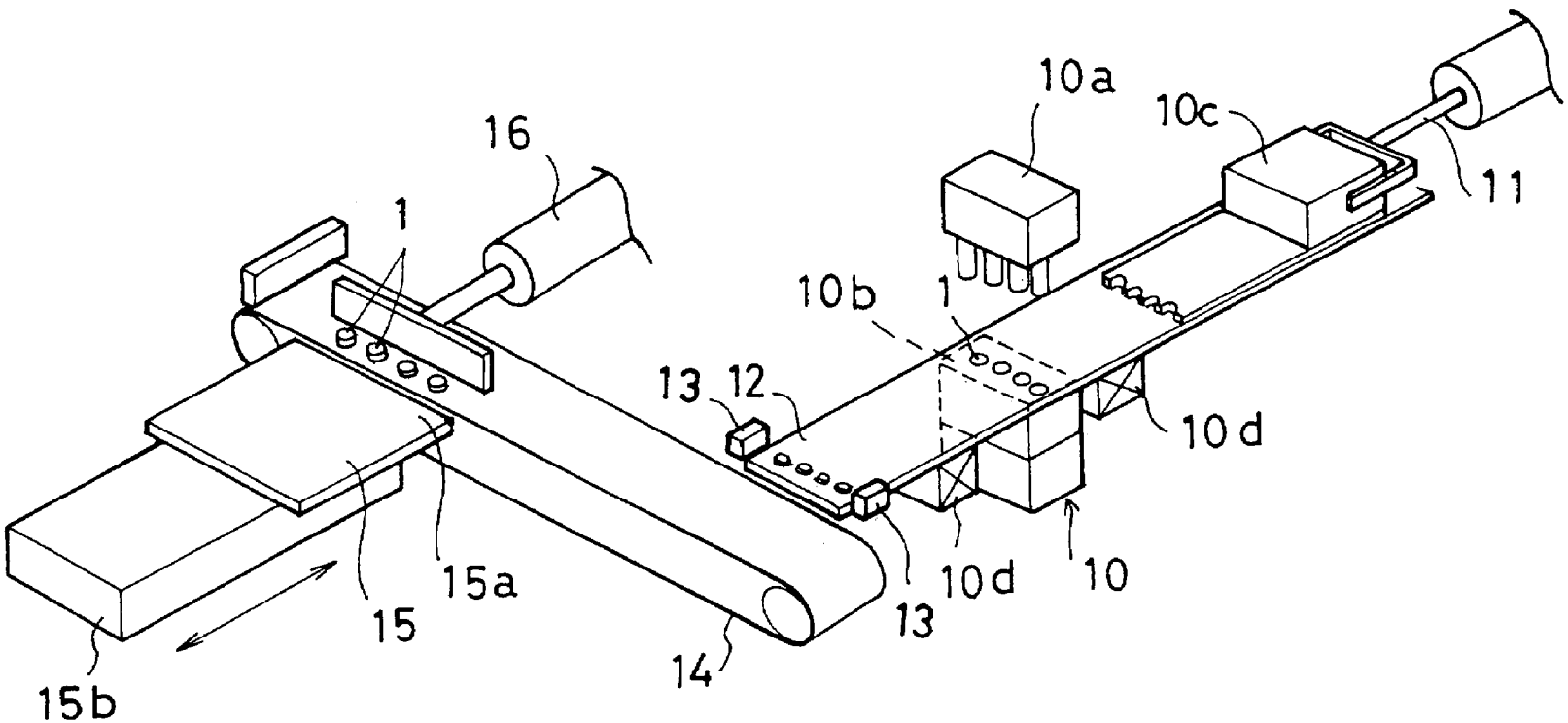
FIG. 7 is a perspective view of the arrangement of another transporting system for carrying out a process for handling green compacts made from a rare earth metal-based magnetic alloy powder by a press machine according to the present invention.

Even in this embodiment, the sintering support plate 15 is constructed so that it can be moved by a drive means 15*b*, and the movement of the green compacts to the sintering support plate 15 is carried out after movement of the sintering support plate 15 to the final transport position near the green compacts 1, as shown in FIG. 7, as in the above-described embodiment.

In this embodiment, components or portions corresponding to those in the above-described embodiment are designated by like reference characters. In addition, the rare earth metal-based alloy powder used is similar to that described above.

Figure 8:
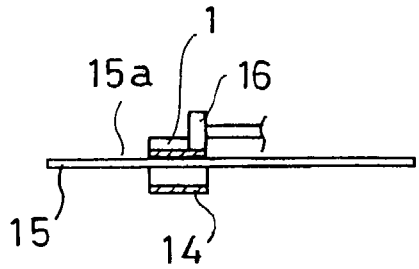
FIG. 8 is a diagram for explaining one step of the handling process.
Figure 9:
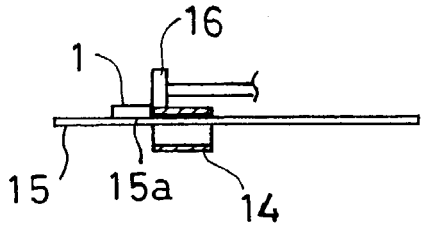
FIG. 9 is a diagram for explaining one step of the handling process.
Figure 10:
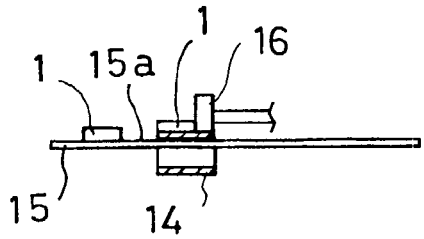
FIG. 10 is a diagram for explaining one step of the handling process.
Figure 11:
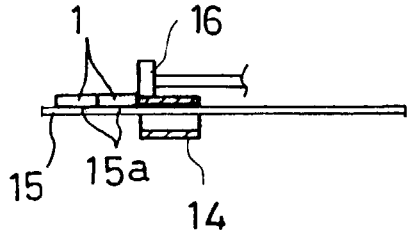
FIG. 11 is a diagram for explaining one step of the handling process.

More specifically, in the movement of the green compacts from the transporting belt 14 onto the sintering support plate 15, the sintering support plate 15 is placed into the transporting belt 14 having an extremely small thickness on the order of 0.5 mm, as shown in FIG. 8. The sintering support plate 15 is moved by the drive means 15*b* to the final transport position 15*a* adjacent the transporting belt 14. In this state, the green compacts 1 are pushed from the transporting belt 14 onto the sintering support plate 15 by a push-out means 16, as shown in FIG. 9. Thereafter, as shown in FIG. 10, the sintering support plate 15 is moved to a new final transport position 15*a* adjacent the transporting belt 14 and then, as shown in FIG. 11, the operation for pushing the green compacts 1 from the transporting belt 14 onto the sintering support plate 15 is repeated, thereby all the green compacts 1 to the final transport position 16*a* of the sintering support plate 15.

In this embodiment, the green compacts 1 can be moved in the above-described manner without little sliding movement on the sintering support plate 15. Each of the green compacts used in this embodiment is in the form of a thin disk having an outside diameter of 45 mm, an inside diameter of 25 mm and a thickness of 2 mm. In this case, a difference in level is produced by the transporting belt, but the distance of sliding movement of the green compacts can be minimized. Therefore, this embodiment is suitable for the arrangement of green compacts which are difficult to be fallen.

Even in this embodiment, of course, the powder removing treatment can be carried out using the turn table, as in the previously described embodiment. It is desirable that the transporting belt is thinner in order to eliminate the difference in level, but it is obvious that the thickness of the transporting belt should be determined with the durability taken into consideration. A thin plate of a stainless steel may be provided between the transporting belt and the sintering support plate to reduce the friction.

In addition, it is, of course, preferable in each of the embodiments to use a support on which the rare earth metal-based magnetic alloy powder green compacts cannot be deposited and which has a surface roughness degree Ra in a range of 0.6 to 47 μm and a surface roughness degree Rmax in a range of 8.9 to 210.

In this embodiment, the control system is particularly not described, but a control similar to that described in the previously described embodiment can be carried out by the CPU using a sensor as described in the previously described embodiment.

The green compacts disposed on the sintering support plate in the above-described manner are transported into a sintering furnace, where they are subjected to a sintering treatment at 1050° C. for two hours in an atmosphere of argon and further subjected to an aging treatment at 600° C. for one hour in the atmosphere of argon, thereby producing a sintered magnet as shown in U.S. Pat. No. 4,770,423.

What is claimed is:

1. A process for handling green compacts made from a rare earth metal-based magnetic alloy powder by a press machine, comprising the step of transporting said green compacts made from the rare earth metal-based magnetic alloy powder by the press machine once onto a turn table, subjecting said green compacts to a powder removing treatment on said turn table, and transporting said green compacts to a sintering support plate.

* * * * *